US010239714B2

(12) United States Patent
Reboul et al.

(10) Patent No.: US 10,239,714 B2
(45) Date of Patent: Mar. 26, 2019

(54) METHOD OF ADJUSTING THE HEIGHTS OF THE NIPPING BELTS IN A TRANSPORT CONVEYOR

(71) Applicant: Solystic, Bagneux (FR)

(72) Inventors: Jean Michel Reboul, Saint Donat (FR); Olivier De Sousa, Montmeyran (FR); Bruno Cartal, Montelier (FR)

(73) Assignee: SOLYSTIC, Bagneux (FR)

( * ) Notice: Subject to any disclaimer, the term of this patent is extended or adjusted under 35 U.S.C. 154(b) by 0 days.

(21) Appl. No.: 15/950,455

(22) Filed: Apr. 11, 2018

(65) Prior Publication Data

US 2018/0305149 A1 Oct. 25, 2018

(30) Foreign Application Priority Data

Apr. 25, 2017 (FR) ..... 17 53587

(51) Int. Cl.
*B65H 5/02* (2006.01)
*B65H 29/12* (2006.01)

(52) U.S. Cl.
CPC ..... *B65H 5/023* (2013.01); *B65H 29/12* (2013.01); *B65H 2301/321* (2013.01); *B65H 2404/255* (2013.01); *B65H 2404/261* (2013.01); *B65H 2553/40* (2013.01); *B65H 2553/46* (2013.01); *B65H 2701/1916* (2013.01)

(58) Field of Classification Search
CPC ..... B65G 15/20; B65G 15/14; B65H 29/12; B65H 5/023
USPC ..... 198/626.1, 626.5
See application file for complete search history.

(56) References Cited

U.S. PATENT DOCUMENTS 6,023,034 A * 2/2000 Nakajima ..... B65H 39/10 198/460.1
6,152,292 A * 11/2000 Matteucci ..... B26D 3/16 198/626.1
6,435,498 B1 * 8/2002 Stefan ..... B07C 1/04 271/10.03
7,001,261 B2 * 2/2006 Johnson ..... A22C 17/0006 452/150
8,322,719 B1 * 12/2012 Roth ..... B65H 29/12 271/198

(Continued)

FOREIGN PATENT DOCUMENTS

DE 10 2012 206784 A1 10/2012
FR 3 008 631 A1 1/2015

*Primary Examiner* — William R Harp
(74) *Attorney, Agent, or Firm* — Ware, Fressola, Maguire & Barber LLP

(57) ABSTRACT

An adjustment method for adjusting the heights of the nipping belts in a transport conveyor that moves flat articles in series and on edge, so that a transport height is substantially constant for the flat articles. The method causes the conveyor to operate empty in such a manner that the nipping belts of heights that are to be adjusted run without any flat article in the conveyor, emits two parallel and superposed light beams towards a belt of height to be adjusted, spaced apart by a certain distance equal to the width of the belt between the two opposite edges of the belt to be adjusted, the light beams emitted from a portable tool, and manipulate a tensioner adjusting the belt so as to move the belt heightwise while it is running empty until the two light beams intersect respective ones of the two opposite edges of the belt.

8 Claims, 1 Drawing Sheet

(56) References Cited

U.S. PATENT DOCUMENTS

| | | | | |
|---|---|---|---|---|
| 9,180,494 | B2 * | 11/2015 | Bernoussi | B65H 3/124 |
| 2009/0133992 | A1 | 5/2009 | Enenkel et al. | |

* cited by examiner

METHOD OF ADJUSTING THE HEIGHTS OF THE NIPPING BELTS IN A TRANSPORT CONVEYOR

CROSS REFERENCE TO RELATED APPLICATIONS

This application claims priority under 35 USC § 119 to French Patent Application No. 1753587 filed on Apr. 25, 2017, which application is hereby incorporated by reference in its entirety.

TECHNICAL FIELD

The invention relates to the technical field of transport conveyors having nipping belts.

The invention relates more particularly to an adjustment method for adjusting the heights of the nipping belts in a transport conveyor that moves flat articles in series and on edge, with a view to obtaining a transport height that is substantially constant for the flat articles while they are being moved by the nipping belts in the conveyor.

PRIOR ART

Transport conveyors having nipping belts are in very widespread use in postal sorting for sorting flat mailpieces such as letters.

Such conveyors are also known as "sorting conveyors" and they have large numbers of sorting outlets.

They are usually designed in modular manner with a plurality of contiguous modules, each of which has a plurality of sorting outlets.

The sorting outlets are formed by as many different nipping belts that extend transversely relative to a main nipping belt, which itself extends along the long length of the module.

It is extremely important in such postal sorting conveyors for the mailpieces to be kept properly horizontal, on edge, and at the same height relative to the bed of the transport conveyor, while they are being moved from one module to another and within the same module. Otherwise they might buckle and give rise to jams in the conveyor.

That is why it is necessary for the transport height of the mailpieces (distance between the lower edge of the mailpiece and the bed) to be adjusted and checked regularly in such postal sorting conveyors by acting on the heightwise positioning of the nipping belts.

Presently, the transport height of mailpieces is checked as follows.

The conveyor is loaded with mailpieces and is then switched off.

The transport height of the mailpieces held by the nipping belts is measured by an operative along the belts. If the transport height varies from one module to another, the operative manipulates belt tensioners to compensate for the height differences, and then switches the conveyor back on and off again in order to take transport height measurements again.

Since there are a large number of nipping belts in such a conveyor, such an adjustment and checking operation is tedious.

SUMMARY OF THE INVENTION

An object of the invention is to propose an adjustment method for adjusting the transport height of flat articles in a transport conveyor having nipping belts that procures highly accurate adjustment and that is also easy and quick to implement, making it possible for the adjustment to be performed by a non-technical operative.

To this end, the invention provides an adjustment method for adjusting the heights of the nipping belts in a transport conveyor that moves flat articles in series and on edge, with a view to obtaining a transport height that is substantially constant for the flat articles while they are being moved by the nipping belts in the conveyor, said adjustment method being characterized in that it comprises the following steps:

- causing the conveyor to operate empty in such a manner that the nipping belts of heights that are to be adjusted run without any flat article in the conveyor;
- emitting two light beams towards a belt of height that is to be adjusted, which light beams are parallel and superposed, being spaced apart by a certain distance equal to the width of the belt between the two opposite edges of the belt of height that is to be adjusted, these two light beams being emitted from a housing having a stand that is calibrated heightwise, i.e. the two light beams are disposed relative to the stand of the housing at a certain height that is calibrated to correspond to said transport height at which the flat articles are transported in the conveyor; and
- manipulating a tensioner over which the nipping belt to be adjusted is engaged so as to move said belt heightwise while it is running empty until the two light beams intersect respective ones of the two opposite edges of the belt.

The method of the invention may also have the following features:

- light beams that are of circular section are emitted, so that when they intersect respective ones of the two opposite edges of the belt, two semicircular spots are observed, one on each of the two opposite edges of the belt, as easily identifiable by a non-technical operative;
- the housing is a portable tool that is provided with a battery that powers light-emitting diodes (LEDs) that produce the two light beams;
- the stand of the housing may be magnetic, thereby making it easier to fasten to the deck of the conveyor while the adjustment is taking place; and
- the housing may be provided with a steerable mirror, thereby making it possible and easier for the operative to manipulate the tensioner while remotely observing an image in the mirror of the two light beams intersecting the belt.

An implementation of the adjustment method of the invention is described below and shown in the drawing.

DESCRIPTION OF IMPLEMENTATIONS

Figure 1:
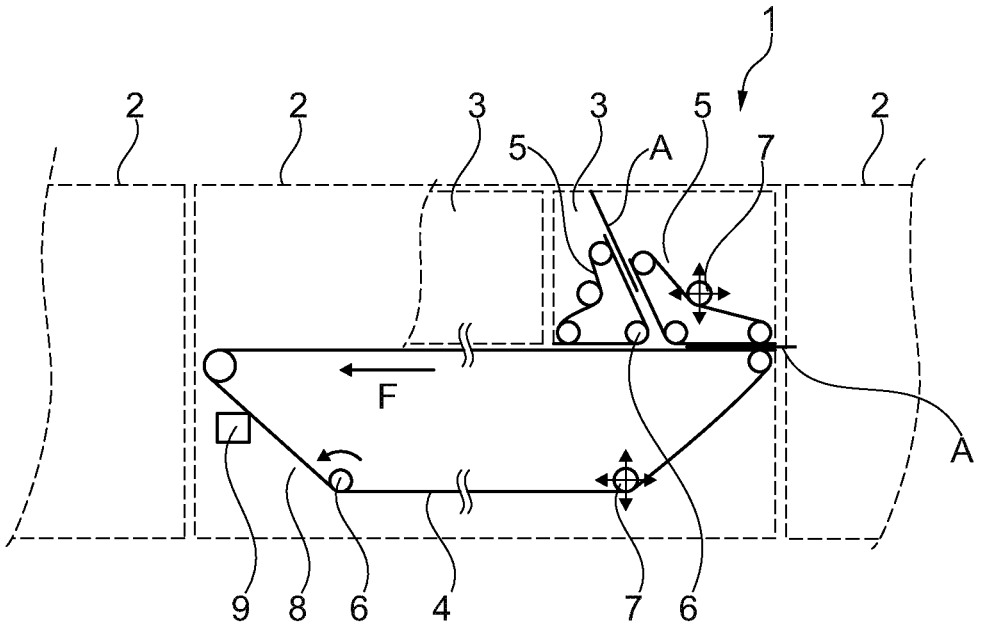
FIG. 1 is a highly diagrammatic view of a modular postal sorting conveyor.

FIG. 1 is highly diagrammatic view showing, by way of an example, a transport conveyor 1 for postal sorting of flat mailpieces, which conveyor is made up of a plurality of adjacent sorting modules 2.

In this example, a sorting module 2 has a plurality of sorting outlets indicated by reference 3 and aligned along the long length of the module in the direction indicated by arrow F.

A sorting conveyor such as 1 may comprise a large number of sorting modules 2 and therefore have a large number of sorting outlets 3.

In the sorting module, mailpieces A are shown that are moved by closed-loop nipping belts inside the module 2.

In this example the nipping belts comprise a main nipping belt 4 and secondary nipping belts 5 that form the sorting outlets of the module.

As shown in FIG. 1, a mailpiece A is nipped flat and on edge (in landscape mode) between the main belt 4 and a secondary belt such as 5, which belts, while they are running, move it on edge above the bed (deck) of the conveyor.

Actually, the mailpiece A does not touch the bed of the conveyor while it is moving with the nipping belts, but rather it tends to lift off slightly above the bed, and the term "height of flight" may be used to describe the transport height at which the mailpiece A is transported.

All of the nipping belts 4, 5 are driven round by motor-driven rollers such as 6, and, along the path of each of the nipping belts, a belt tensioner is provided that, in this example, is in the form of a steerable pulley that has its axis of rotation off-center and that is designated in FIG. 1 by reference 7.

This type of steerable pulley is well-known to the person skilled in the art. The belt 4 that is engaged over a steerable pulley 7 can be raised or lowered above the bed 8 of the module.

The method of the invention for adjusting the transport height of flat articles such as mailpieces in a sorting conveyor such as 1 in FIG. 1, uses a contactless adjustment tool that makes it possible to check the heightwise positions of the nipping belts in the conveyor, while it is operating.

Figure 2:
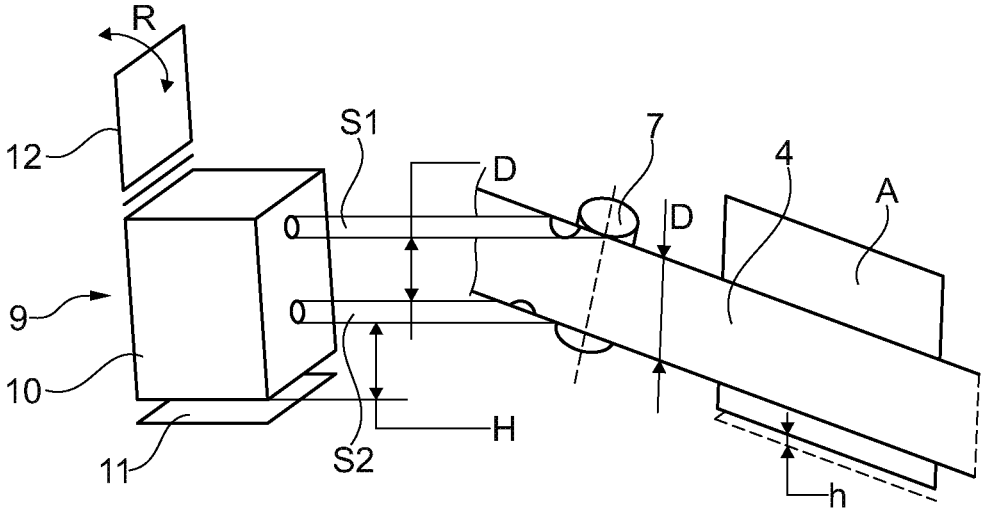
FIG. 2 is a highly diagrammatic view of an example of a tool that emits light beams for implementing the method in the sorting conveyor shown in FIG. 1.

This tool is referenced 9 in FIG. 1 and is shown in more detail in FIG. 2.

The tool 9 is an emitter that is suitable for producing two superposed light beams S1, S2 that are parallel and that are spaced apart by a distance equal to the width D of the nipping belt of height that is to be adjusted.

The emitter is in the form of a portable housing 10 in which two LEDs are disposed that are powered by an electric battery that is not shown in FIG. 2.

The housing 10 has a stand 11 that may be magnetic so as to fasten detachably to the horizontal deck 8 of the sorting conveyor that forms the bed of the conveyor.

The height of the stand 11 may be adjustable so that the height between the deck 8 and the beam S2 that is indicated by H in FIG. 2 is adjustable and corresponds to the desired transport height h of the mailpiece.

The top of the housing 10 may be provided with a steerable mirror 12 that is, for example, mounted to fold down onto the housing 10 as indicated by the double-headed arrow R.

The adjustment method of the invention for adjusting the heights of the belts 4, 5 and therefore the transport height h at which mailpieces such as A in FIG. 2 are transported in the module 2 of the sorting conveyor comprises the steps consisting, for an operative performing the adjustment or checking, in:

switching the conveyor on, and causing it to operate empty, i.e. without any mail A between the belts 4, 5 while said belts are running;

placing the tool 9 on the deck 8 in the vicinity of the adjustment pulley 7 so that it emits the two light beams S1 and S2;

steering the emitter tool 9 so that the two light beams S1 and S2 intersect the belt of height that is to be adjusted, e.g. the belt 4, if possible at right angles;

manipulating the inclined adjustment pulley 7 over which the belt 4 is engaged so as to cause the belt 4 to be lowered or raised, the manipulation of the pulley 7 consisting, for example, in causing the inclined axis of rotation of the pulley 7 to pivot in one direction or the other, thereby causing the belt 4 to be lowered or to be raised; and causing the adjustment to cease when the two light beams S1 and S2 intersect respective ones of the two opposite edges of the belt 4, i.e. when the belt is centered between the two light beams.

In accordance with the invention, the two light beams S1 and S2 are of circular section so that the adjustment is correct when two semi-circular spots are observed on respective ones of the two opposite edges of the belt, as shown in FIG. 2.

In practice, in a sorting conveyor with a large number of sorting modules 2, the operative has to adjust a large number of nipping belts with the tool 9, and therefore has to manipulate a certain number of inclined pulleys 9 distributed along the path of the nipping belts.

The operative therefore adjusts the heights of all of the nipping belts of the conveyor by using the portable tool 9.

In addition, adjusting the height of a nipping belt, such as the belt 4, should, in general, be performed at two spaced apart points of the belt, e.g. at the inlet and at the outlet of the module 2. The operative must therefore place the tool 9 at the inlet of the module and manipulate the pulley 7 over which the belt 4 is engaged in order to adjust the height of the belt at the inlet of the module. Then the operative moves the tool 9 to the outlet of the module and starts manipulating the pulley 7 again in order to adjust the height of the belt at the outlet of the module. Moving and positioning the tool 9 is facilitated if the housing of the tool has a magnetic stand that is easy to fasten to and to detach from the deck of the conveyor, which deck is made of metal.

If the space between the inclined pulley 7 manipulated by the operative and the adjustment point at which the tool 9 is placed is quite large or is obstructed visually, the operative can nevertheless observe remotely in the mirror 12 the image of the light beams S1 and S2 on the belt in such a manner as to adjust the height of the nipping belt accurately.

The invention claimed is:

1. An adjustment method for adjusting heights of nipping belts in a transport conveyor that move flat articles in series and on edge, with a view to obtaining a transport height that is substantially constant for the flat articles while they are being moved by the nipping belts in the conveyor, said adjustment method comprising:

causing the conveyor to operate empty in such a manner that the nipping belts of heights that are to be adjusted run without any flat article in the conveyor;

emitting two light beams towards a belt of height that is to be adjusted, which light beams are parallel and superposed, being spaced apart by a certain distance equal to the width of the belt between the two opposite edges of the belt of height that is to be adjusted, these two light beams being emitted from a housing having a stand that is calibrated heightwise so that the two light beams are disposed relative to the stand of the housing at a certain height that is calibrated to correspond to said transport height at which the flat articles are transported in the conveyor; and manipulating a tensioner over which the nipping belt to be adjusted is engaged so as to move said belt heightwise while it is running empty until the two light beams intersect respective ones of the two opposite edges of the belt.

2. The adjustment method according to claim 1, wherein light beams that are of circular section are emitted, and when the light beams intersect respective ones of the two opposite edges of the belt, two semicircular spots are observed, one on each of the two opposite edges of the belt.

3. The method according to claim 2, wherein the housing is a portable tool that is provided with a battery that powers LEDs that produce the two light beams.

4. The method according to claim 3, wherein the stand of the housing is magnetic.

5. The method according to claim 4, wherein the housing is provided with a steerable mirror.

6. The method according to claim 1, wherein the housing is a portable tool that is provided with a battery that powers LEDs that produce the two light beams.

7. The method according to claim 1, wherein the stand of the housing is magnetic.

8. The method according to claim 1, wherein the housing is provided with a steerable mirror.

* * * * *